US010376001B1

(12) United States Patent
Williams et al.

(10) Patent No.: US 10,376,001 B1
(45) Date of Patent: Aug. 13, 2019

(54) SPORTS SHOULDER PADS HAVING EPAULETTES CONTAINING SLOW-RESPONSE FOAM INSERTS

(71) Applicant: Kranos IP Corporation, Litchfield, IL (US)

(72) Inventors: Fred Williams, Jacksonville, FL (US); Scott Williams, Jacksonville, FL (US)

(73) Assignee: KRANOS IP CORPORATION, Litchfield, IL (US)

( * ) Notice: Subject to any disclaimer, the term of this patent is extended or adjusted under 35 U.S.C. 154(b) by 0 days.

(21) Appl. No.: 16/123,398

(22) Filed: Sep. 6, 2018

Related U.S. Application Data

(60) Provisional application No. 62/679,473, filed on Jun. 1, 2018, provisional application No. 62/653,713, filed on Apr. 6, 2018.

(51) Int. Cl.
*A41D 13/015* (2006.01)
*A41D 13/05* (2006.01)
(Continued)

(52) U.S. Cl.
CPC ..... *A41D 13/0512* (2013.01); *A41D 13/0153* (2013.01); *A63B 71/12* (2013.01); *A63B 2243/007* (2013.01)

(58) Field of Classification Search
CPC .. A47C 27/15; A47G 2009/1018; B32B 5/18; B32B 2266/0278; B32B 2266/06; B32B 2305/022; B32B 2375/00; B32B 27/40; B32B 5/245; A63B 71/12; A63B 2209/10; A63B 2071/1208; A63B 2102/14; A63B 2102/24; A63B 2243/007; A41D 13/0153; A41D 13/0015; A41D 13/05;
(Continued)

(56) References Cited

U.S. PATENT DOCUMENTS 4,957,798 A * 9/1990 Bogdany ..... A47G 27/0468 428/95
5,114,773 A * 5/1992 Bogdany ..... A47G 27/0468 427/244
(Continued)

OTHER PUBLICATIONS

SGB Media, Schutt Partners with Pro Gear Sports, Mar. 16, 2017.
(Continued)

*Primary Examiner* — Robert H Muromoto, Jr.
(74) *Attorney, Agent, or Firm* — Notaro, Michalos & Zaccaria P.C.

(57) ABSTRACT

A shoulder pad assembly for protecting the body during sports play has a pair of arches connected to each other in the front and in the back by connecting straps, webs, or similar connectors. Shoulder caps are connected to the arches by a flexible connecting structure, for example, webs, straps, or bands. Epaulets are attached by webs, straps, or bands, at the top of each arch. The arches and shoulder caps are lined with a shock-absorbing liner. Each of the epaulets contains a shock absorbing insert made of slow-response foam, slow-rebound foam or memory foam, encased in a nylon or fabric shell. Redundant pads, made of slow-response foam, slow-rebound foam or memory foam, encased in a nylon or fabric shell may be inserted below the top of each of the left arch and right arch, to provide additional padding in those areas.

10 Claims, 12 Drawing Sheets

(51) Int. Cl.
*A63B 71/12* (2006.01)
*A41D 13/00* (2006.01)

(58) Field of Classification Search
CPC .... A41D 13/0568; A41D 27/12; A42B 3/063; A42B 3/125; A43B 17/02; A43B 17/14; A43B 1/0009
See application file for complete search history.

(56) References Cited

U.S. PATENT DOCUMENTS 5,152,081 A * 10/1992 Hallenbeck ..... A43B 1/0009 36/114
7,284,342 B2 * 10/2007 Avent ..... A43B 17/02 36/28
8,069,498 B2 * 12/2011 Maddux ..... A42B 3/124 2/414
2002/0044415 A1 * 4/2002 Pavol ..... G11B 33/08 361/679.36
2005/0102741 A1 * 5/2005 McQueer ..... A41D 13/0015 2/459
2006/0026866 A1 * 2/2006 Avent ..... A43B 17/02 36/44
2007/0050886 A1 * 3/2007 Brassill ..... A41D 13/0153 2/115
2011/0041252 A1 * 2/2011 DeFranks ..... A47C 27/064 5/655.8
2013/0263386 A1 * 10/2013 Romero ..... A47G 9/00 8/137
2014/0245528 A1 * 9/2014 Williams ..... A63B 71/12 2/461
2016/0367041 A1 * 12/2016 Romero ..... A47G 9/00
2017/0303622 A1 * 10/2017 Stone ..... A42B 3/064

OTHER PUBLICATIONS

AEMA, AEMA Announces Finalists and Winner of Breakout Product of 2017, Jun. 12, 2017.
National Football League, Transcript of 2018 Injury Data Results, Jan. 24, 2019.

* cited by examiner

SPORTS SHOULDER PADS HAVING EPAULETTES CONTAINING SLOW-RESPONSE FOAM INSERTS

CROSS-REFERENCE TO RELATED APPLICATIONS

This application claims priority from U.S. Provisional Patent Application Ser. No. 62/653,713 filed Apr. 6, 2018, which entire application is incorporated herein for all purposes. Additionally, this application claims priority from U.S. Provisional Patent Application Ser. No. 62/679,473 filed Jun. 1, 2018, which entire application is incorporated herein for all purposes.

FIELD AND BACKGROUND OF THE INVENTION

Shoulder pads are assemblies of protective gear worn to protect the shoulders and portions of the torso from collisions sustained in sports play. Shoulder pads are generally composed of a pair of arches connected to each other in the front and in the back by connecting means such as straps, webs, or similar means. A pair of shoulder caps is flexibly connected to the arches by a flexible connecting structure such as webs, straps or bands, and configured to overlay and protect the shoulder. Shoulder pads for use in football conventionally have a separate attached epaulet flexibly attached to the apex of each arch by webs, straps, or bands. The epaulets partially overlie the top of the arch and the adjacent shoulder cap.

The arches, shoulder caps, and epaulets are conventionally formed of a moldable, durable, substantially rigid material such as a suitable plastic material such as acrylonitrile butadiene styrene (ABS) or polycarbonate plastic. The arches and shoulder caps are in contact with the wearer's body (over the jersey or other basic clothing) and are provided with inner padding to absorb shock and increase comfort. The epaulets are not in contact with the body, but are in contact with the outer surface of the arches and shoulder caps.

For the aesthetic reason of muffling the clashing sound of the hard plastic epaulets contacting the hard plastic arches and shoulder caps, epaulets are sometimes provided with a cloth lining, a cloth bias strip around the edge of the epaulet where it would make contact, an elastomer coating, or a Styrofoam member. These additions to the epaulets are not effective to absorb shocks during sports play. Styrofoam additions suffer from the defect that they are not resilient and will be crushed at the first impact and will not rebound (although even when crushed they are still effective for the purpose of muffling sound).

SUMMARY OF THE INVENTION

According to the subject technology, a shoulder pad assembly comprises a pair of arches connected to each other in the front and in the back by connecting means such as straps, webs, or similar means; shoulder caps connected to the arches by a flexible connecting structure, for example, webs, straps, or bands; and epaulets attached by webs, straps, or bands, at the top of each arch; the arches and shoulder caps lined with a shock-absorbing liner; and each of the epaulets containing a shock absorbing insert comprised of slow-response foam, slow-rebound foam or memory foam. The inventors have discovered that the inclusion of slow-response foam inserts in the epaulets is surprisingly effective at improving the protective performance of the shoulder pads assembly.

The subject technology relates to an impact dispersing ("I.D.") shoulder pad epaulet cushion including an open cell PORON® foam cushion positioned on the underside of a football shoulder pad epaulet or flap. The epaulet is usually the first point of impact by an opposing player to the shoulder pad of another player. The PORON® foam cushion is positioned and attached, by rivets and washers, to the underside of the epaulet. The epaulet, when attached to the shoulder pad, rests on the apex of the shoulder pad arch. When worn by a football player the shoulder pad is positioned over the shoulders and upper torso of that player. The PORON® foam (known as SRS or slow rebound foam) responds to an impact by an opposing player and disperses some of the energy from the blow of the impact. That allows less energy to be absorbed by the main body cushion of the shoulder pad, minimizing the amount of energy transferred to the players torso. The I.D epaulet cushion is a first line of defense against the amount of energy transferred to the players body.

DETAILED DESCRIPTION OF THE INVENTION

Figure 1:
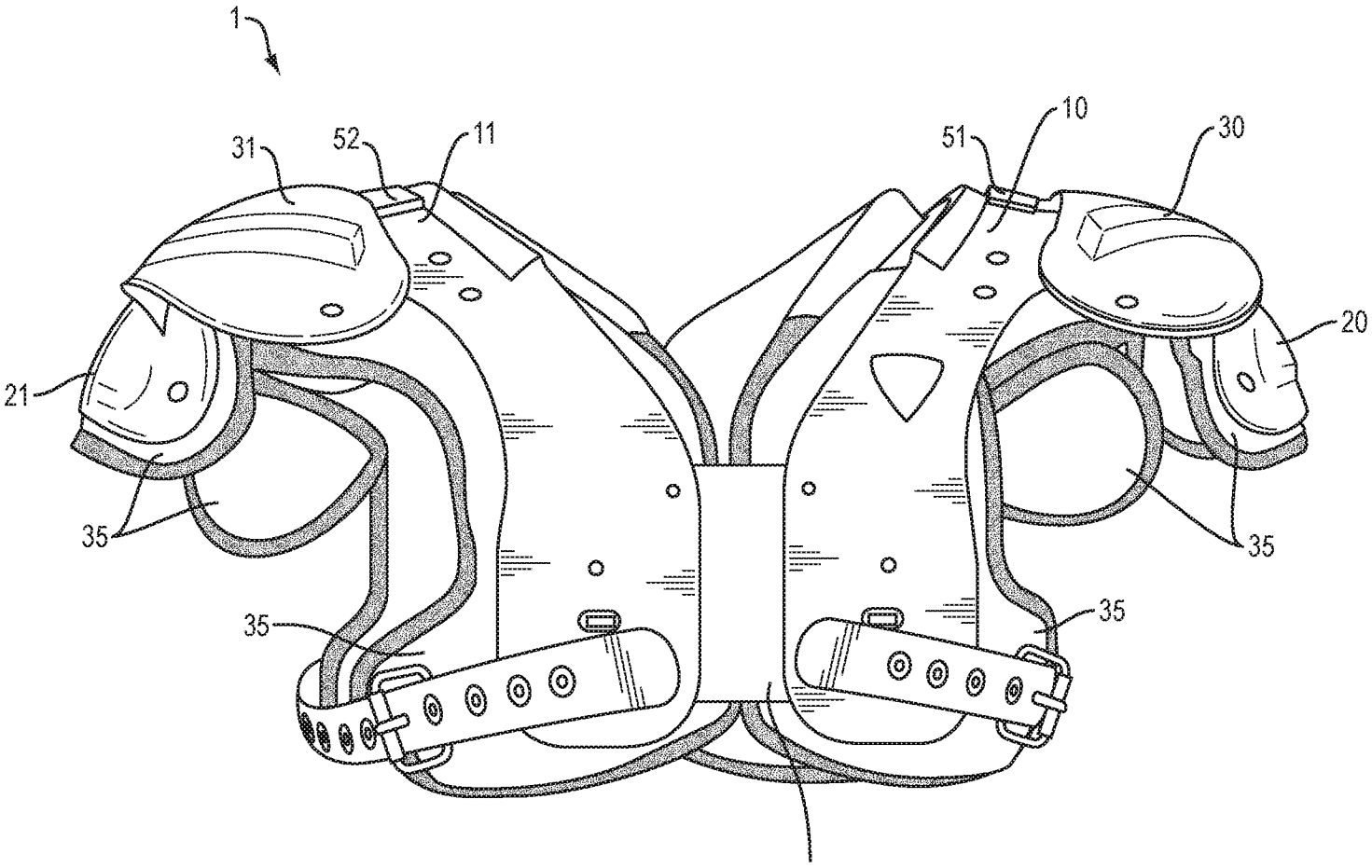
FIG. 1 is a front view of football shoulder pads according to an embodiment of the subject technology.
Figure 2:
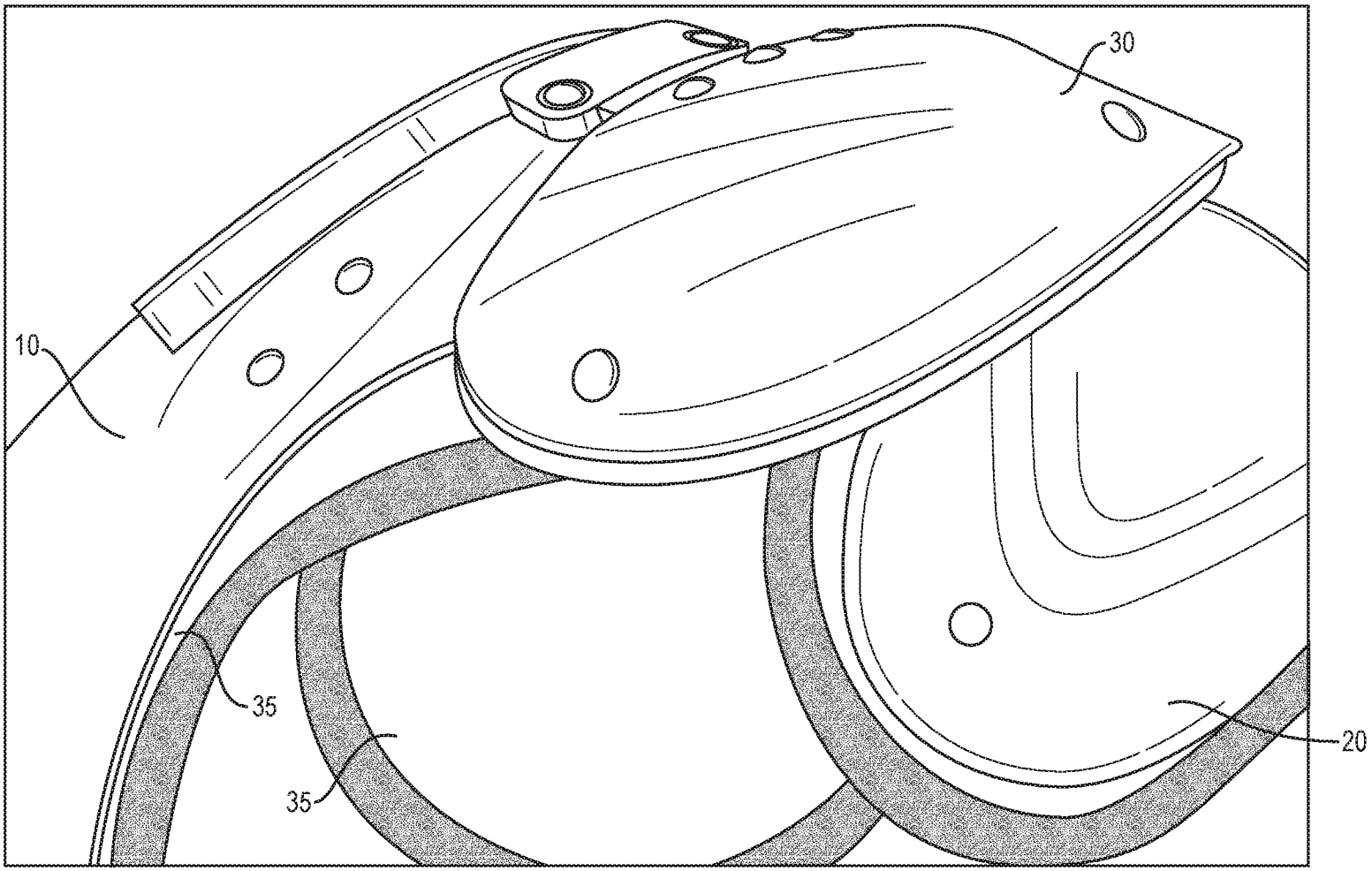
FIG. 2 is a view of a left shoulder area of football shoulder pads according to the subject technology.
Figure 5:
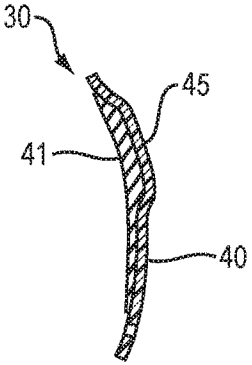
FIG. 5 is a cross-sectional view of an epaulet according to an embodiment of the subject technology along line 5-5 in FIG. 3.

As shown in FIGS. 1 and 2, a shoulder pad assembly 1 according to the subject technology comprises a left arch 10, a right arch 11, the left arch and right arch connected together at the front and back by flexible webs, straps, or bands, a left shoulder cap 20 attached to the left arch 10 by flexible webs, straps, or bands, a right shoulder cap 21 connected to the right arch 11 by flexible webs, straps, or bands 50, a left epaulet 30 connected to the top of the left arch 10 by flexible webs, straps, or bands 51 and overlaying the top edge of the left arch 10 and overlaying the left shoulder cap 20, and a right epaulet 31 connected to the top of the right arch 11 by flexible webs, straps, or bands 52 and overlaying the top edge of the right arch 11 and overlaying the right shoulder cap 21. The arches, shoulder caps, and epaulets may be made of conventional materials for such purposes as are known in the art including ABS, HDPE or polycarbonate plastic, and by conventional means of manufacturing.

Body padding 35 is disposed on the inner surface of the arches 10, 11 and shoulder caps 20, 21 to provide shock absorption, comfort and fit. Body padding 35 may be conventional padding liners for shoulder pad arches and shoulder caps as known in the art. The padding liners may comprise slow-response foam pads, which may be open-cell PORON® foam pads, encapsulated in a cloth shell. The padding liners may consist of, or comprise, TPU shock absorbing inserts as disclosed in U.S. Published Patent Applications No. 2012/0198605, 2016/0270473, and/or U.S. Pat. Nos. 8,069,498, 8,201,269, 9,131,744, 9,326,561, and/or 9,622,533, which are assigned to the assignee of the present application, and are incorporated by reference in their entirety for all purposes.

FIGS. 3-10 show an embodiment of an epaulet according to an embodiment of the present technology. These figures show a left epaulet 30, it should be understood that a right epaulet 31 according to an embodiment of the present technology would be identical to, or a mirror image of, the left epaulet 30.

Epaulet 30 comprises an epaulet shell 40 which is generally concave and which defines an inner cavity. Epaulet shell 40 may include one or more molded ridges for additional stiffness. In the embodiment of FIG. 2, epaulet shell 40 includes a single V-shaped ridge 45. However, epaulet shell 40 could have more than one ridge, and the ridge or ridges could be of various shapes.

The inner cavity of epaulet 30 contains a shock absorbing insert 41, comprising a body made of slow-response foam material, also known as memory foam material. A urethane slow-response foam material sold by Rogers Corporation of Rogers, Conn. under the name PORON® is suitable for foam material. Other slow-response foam materials are also suitable for use as foam material. The body is encapsulated in a fabric shell, which may be a nylon shell heat-sealed to the foam body. The body may be die-cut from foam stock of a suitable thickness to a shape that fits within the cavity of the epaulet shell 40. The body may have a thickness of 0.25 inch, or approximately 0.25 inch, or 6 mm, or approximately 6 mm, or of sufficient thickness to line or substantially line the inner cavity of epaulet shell 40. Insert 41 may be shaped in a crescent or kidney-shaped form defining a concavity 46, so that when installed in the complete shoulder pad assembly, insert 41 does not cover the connection area 47 at which the connecting straps or webbing are attached to epaulet 30. For example, the insert 41 could extend as far as line 44 (in FIGS. 7 and 8). Alternatively, the insert 41 is sized and shaped to cover the connection point 47.

Figure 15:
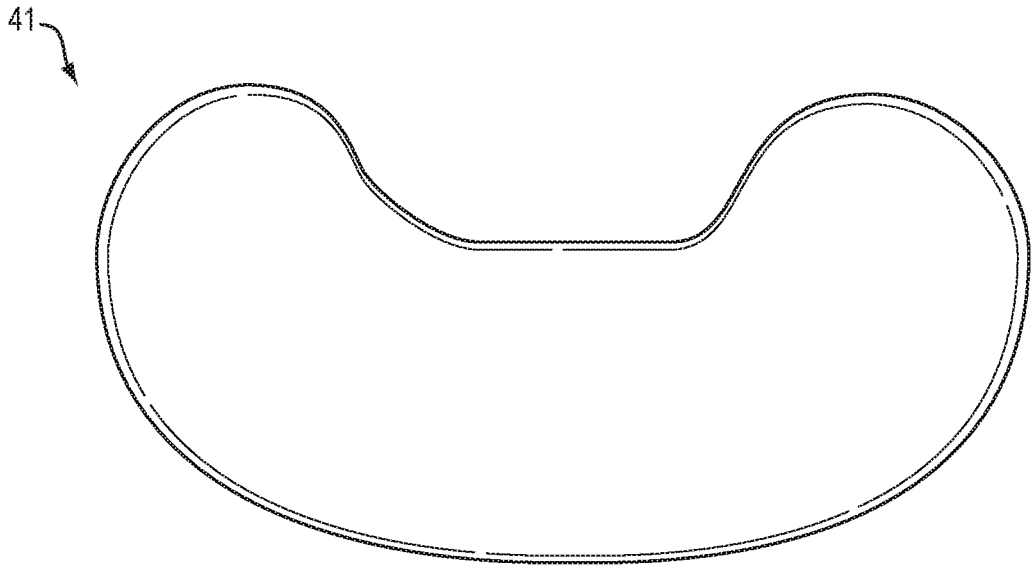
FIG. 15 is a view of an insert pad according to an embodiment of the subject technology.
Figure 16:
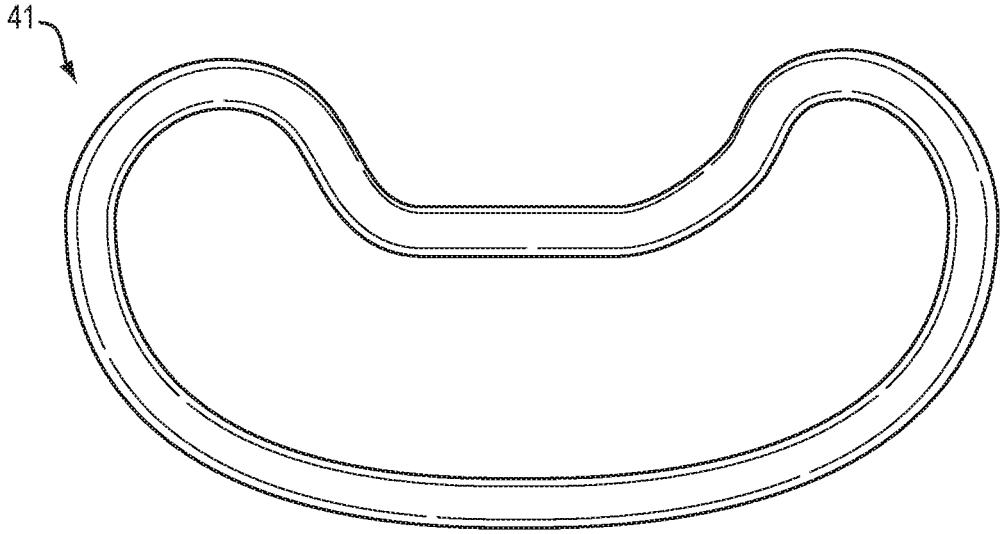
FIG. 16 is a view of the reverse of the insert pad of FIG. 13.
Figure 17:
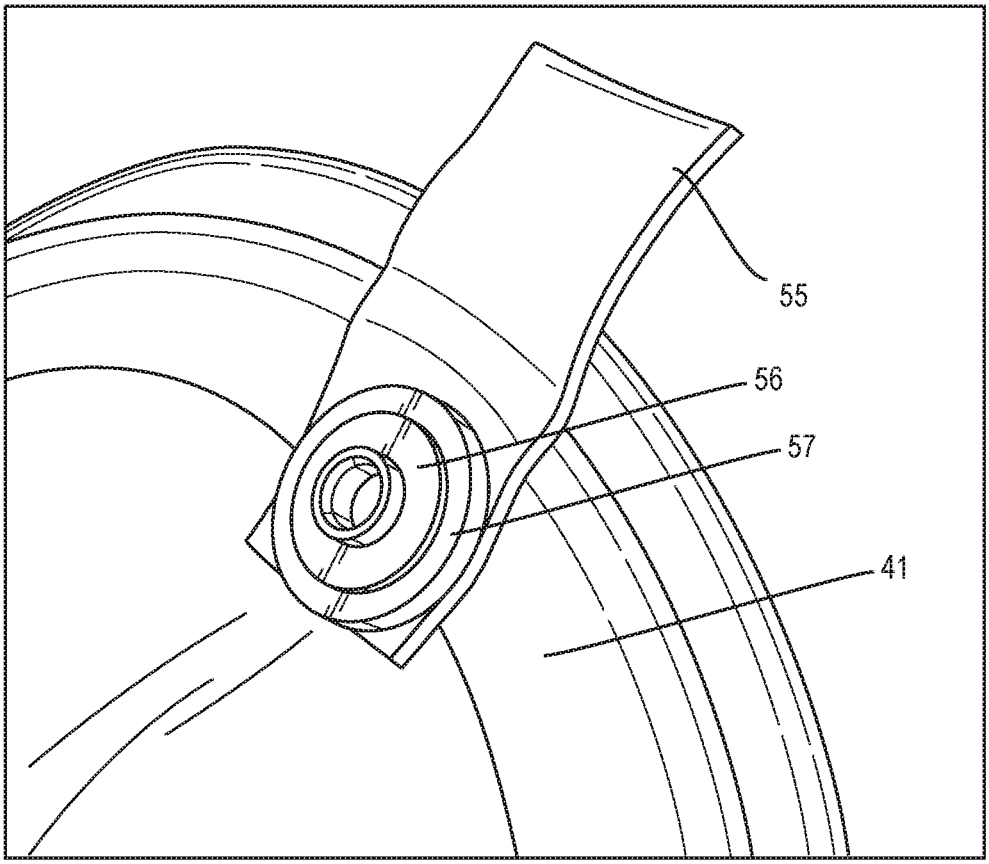
FIG. 17 is a view of the reverse side of the epaulet shown in FIG. 11.

Shock absorbing insert 41 is retained in epaulet shell 40 by rivets and washers. Rivets may be driven through a strip 55 of elastomer such as rubber, the strip folded back on itself to cover the end of the rivet and washer (best seen in FIG. 15, which shows rivet 56 driven through washer 57 and strip 55).

Figure 6:
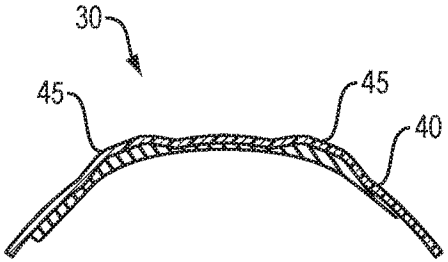
FIG. 6 is a cross-sectional view of an epaulet according to an embodiment of the subject technology along line 6-6 in FIG. 3.
Figure 3:
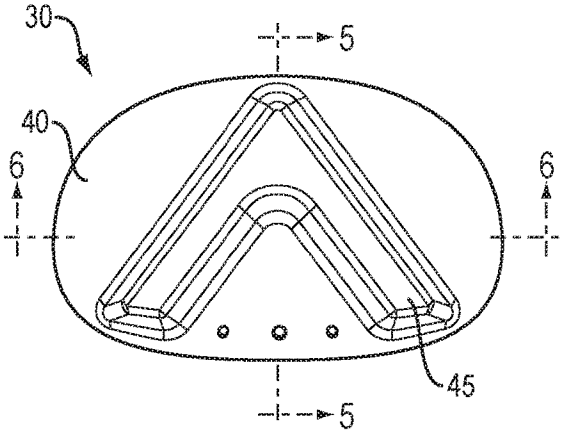
FIG. 3 is a plan view of an epaulet according to an embodiment of the subject technology.
Figure 4:
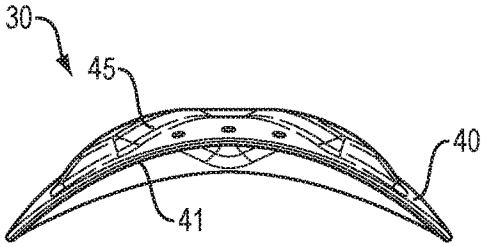
FIG. 4 is a side view of an epaulet according to an embodiment of the subject technology.
Figure 8:
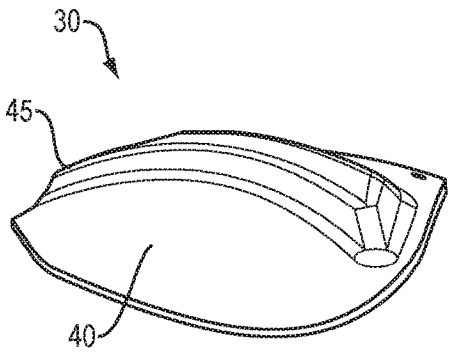
FIG. 8 is a perspective view of an epaulet according to an embodiment of the subject technology.
Figure 7:
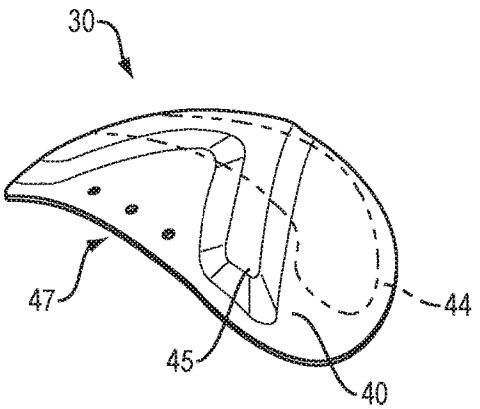
FIG. 7 is a perspective view of an epaulet according to an embodiment of the subject technology. Line 44 should be understood to be a hidden line.
Figure 9:
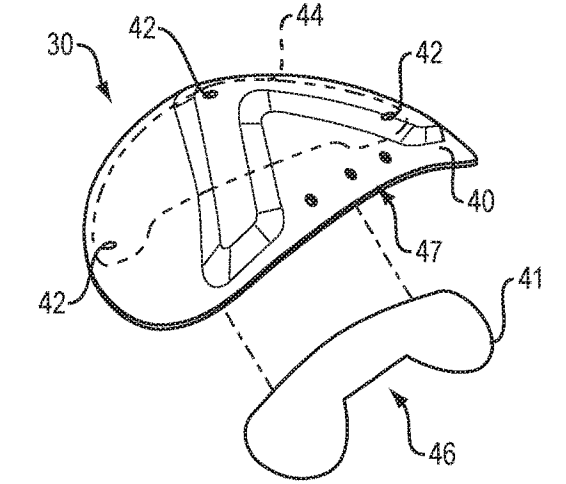
FIG. 9 is a perspective view of an epaulet according to an embodiment of the subject technology. Line 44 should be understood to be a hidden line.
Figure 10:
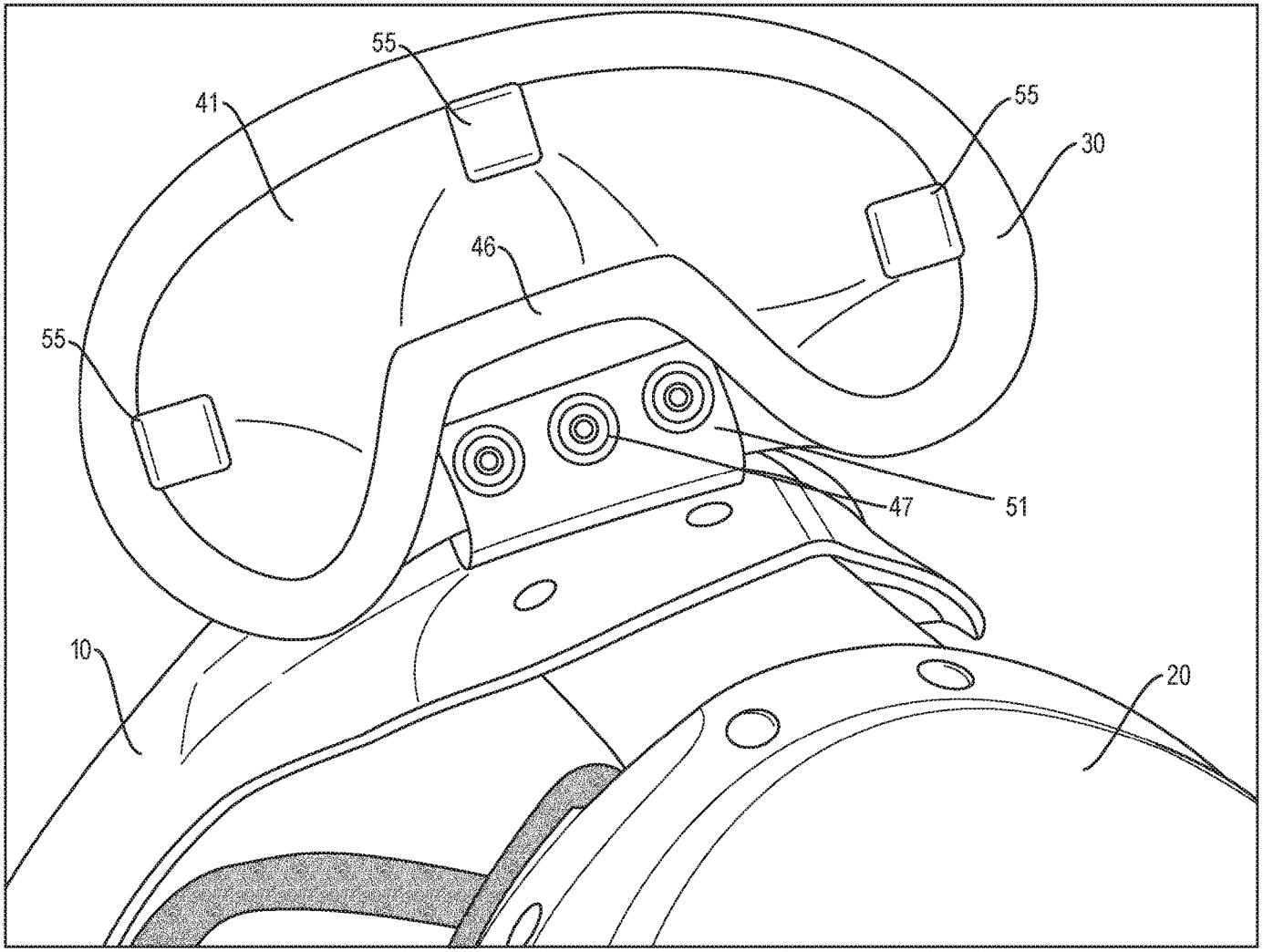
FIG. 10 is a view of a left shoulder area of football shoulder pads according to the subject technology.
Figure 11:
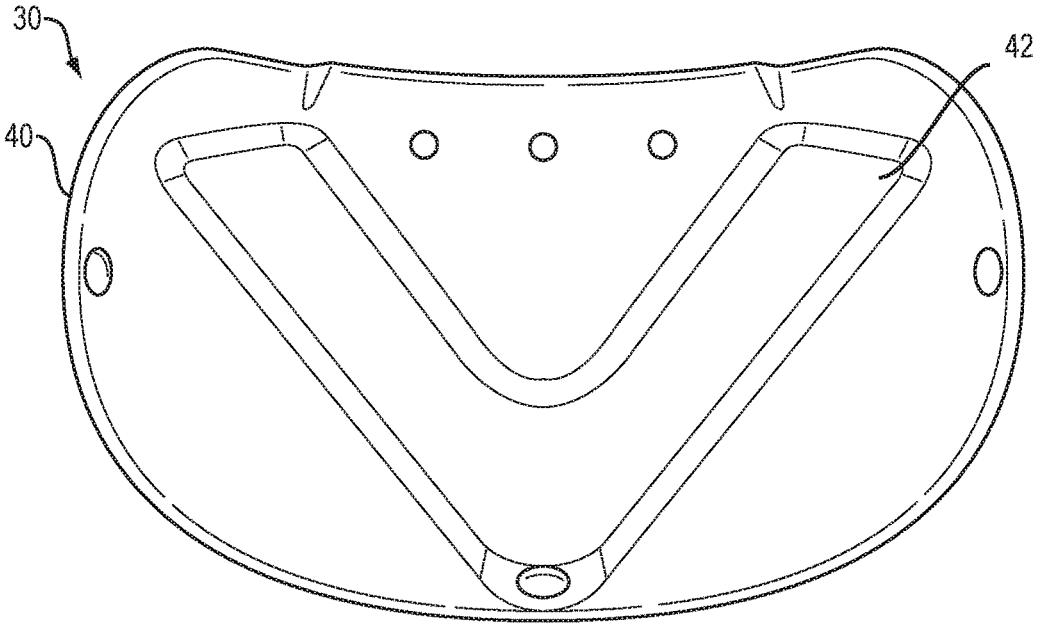
FIG. 11 is a view of an epaulet according to an embodiment of the subject technology.
Figure 12:
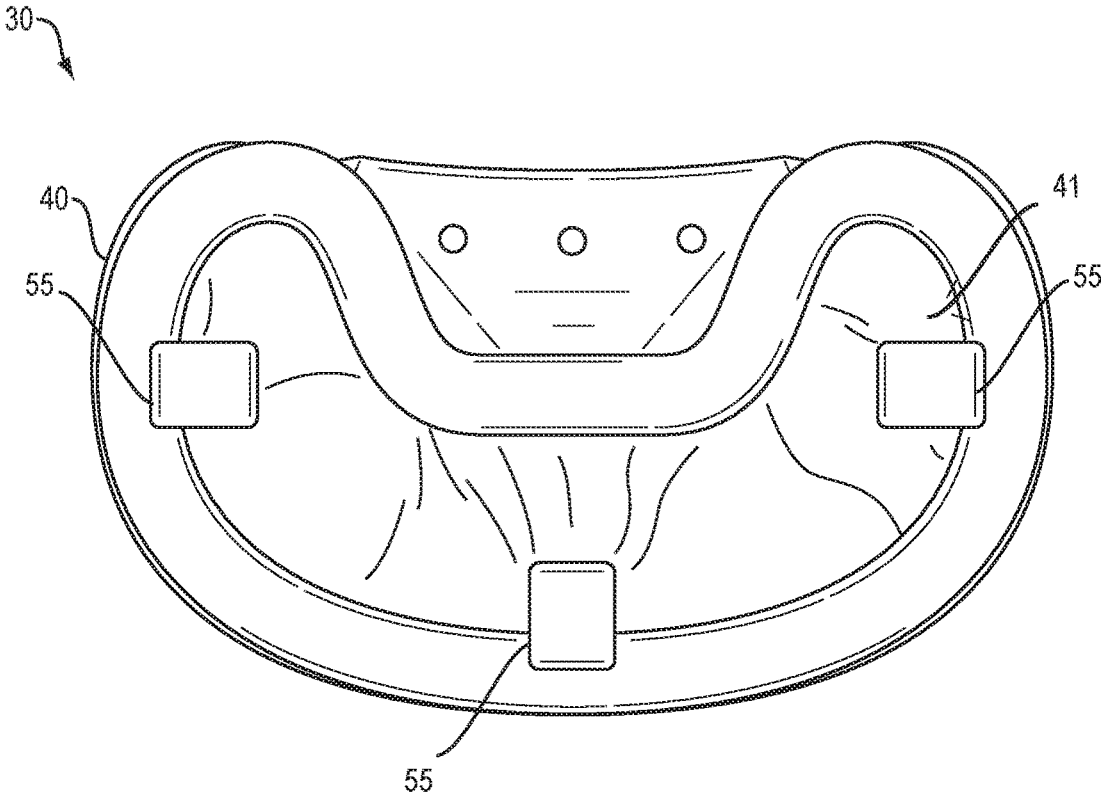
FIG. 12 is a view of the reverse side of the epaulet shown in FIG. 11.
Figure 13:
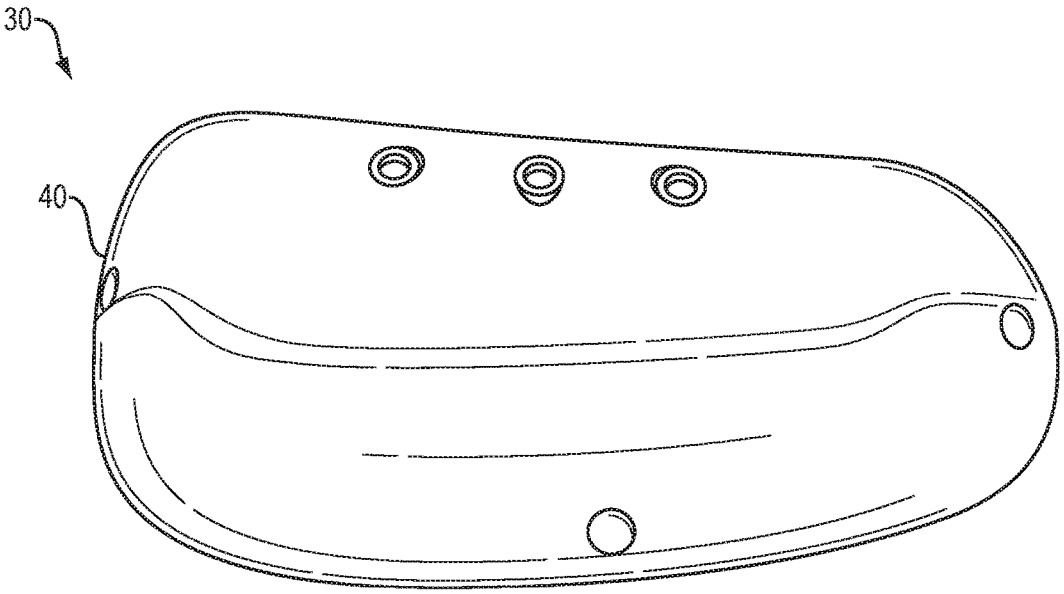
FIG. 13 is a view of an epaulet according to an embodiment of the subject technology.
Figure 14:
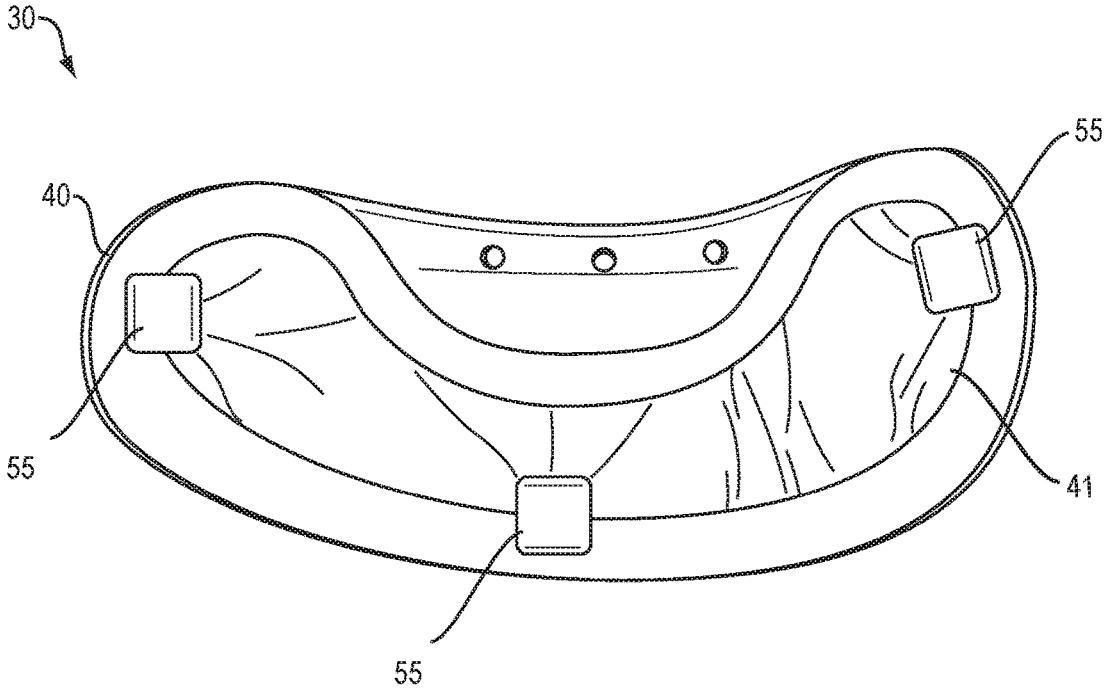
FIG. 14 is a view of the reverse side of the epaulet shown in FIG. 13.

As best seen in FIG. 6, where shell 40 includes a ridge 45, a portion of the insert 41 may reside in the concavity formed by the ridge. Epaulet 30 may further include a sound-muffling cloth bias strip 42 around the edge of shell 40 (best seen in FIG. 10).

Figure 18:
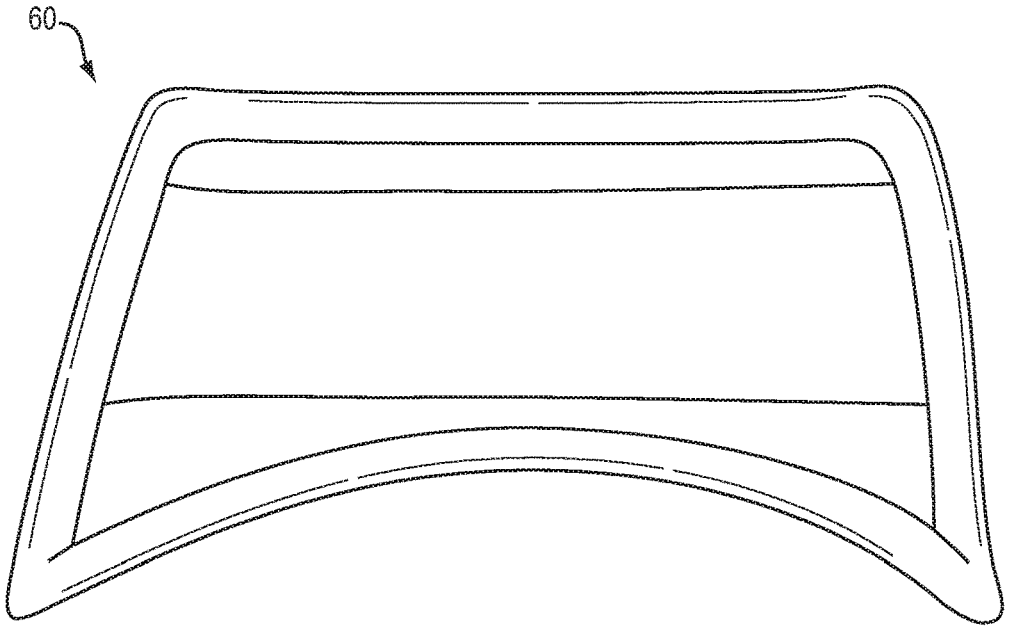
FIG. 18 is a view of a redundant pad according to an embodiment of the subject technology.
Figure 19:
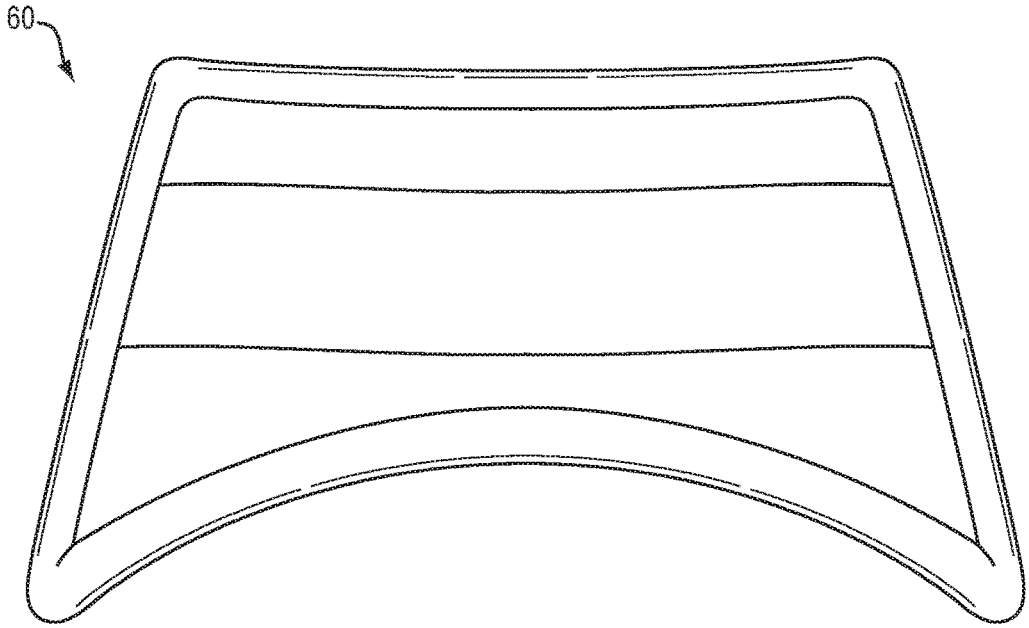
FIG. 19 is a view of the reverse side of the redundant pad shown in FIG. 18.
Figure 20:
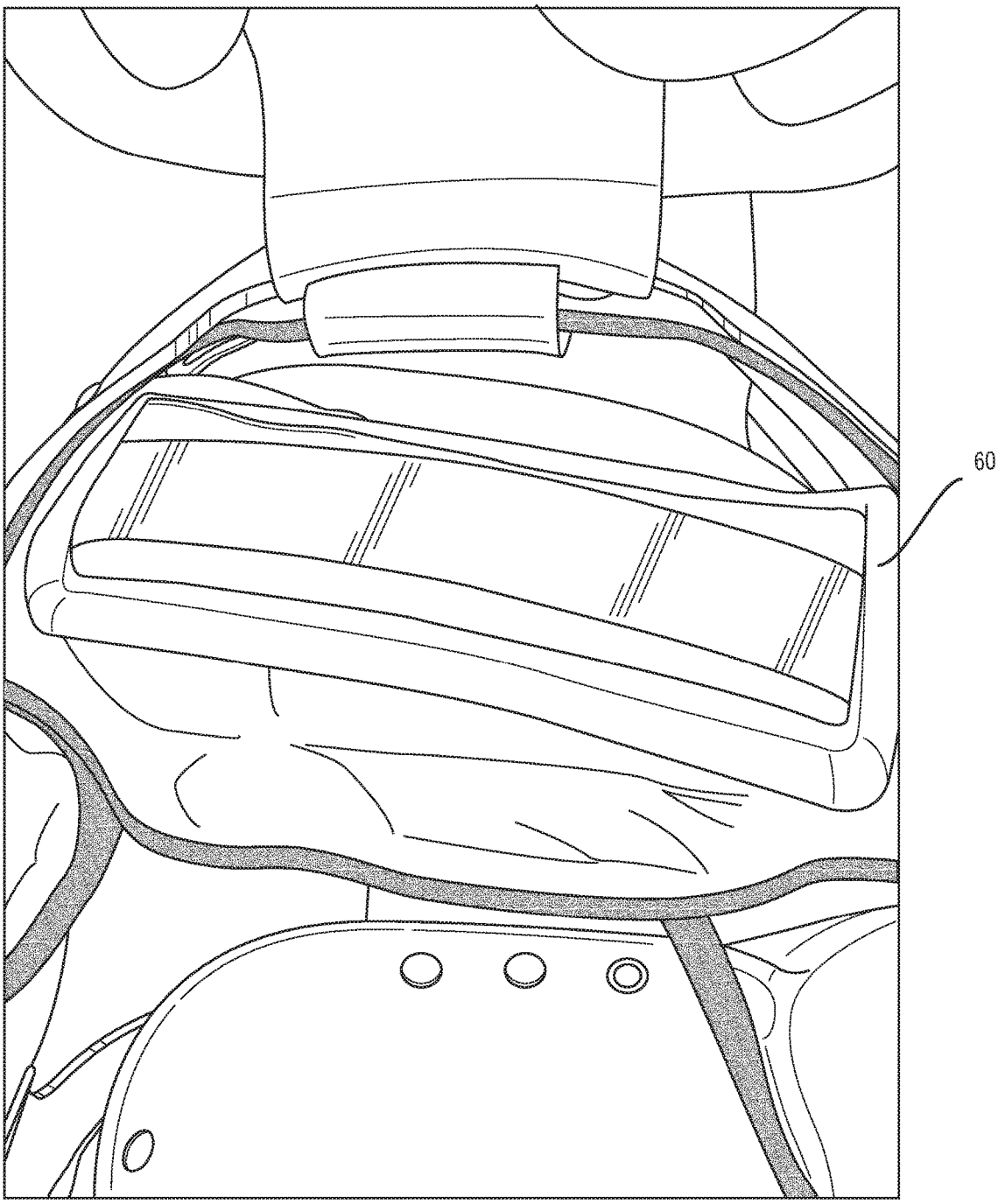
FIG. 20 is a view showing the redundant pad of FIGS. 18-19 as installed beneath the top of the right arch.
Figure 21:
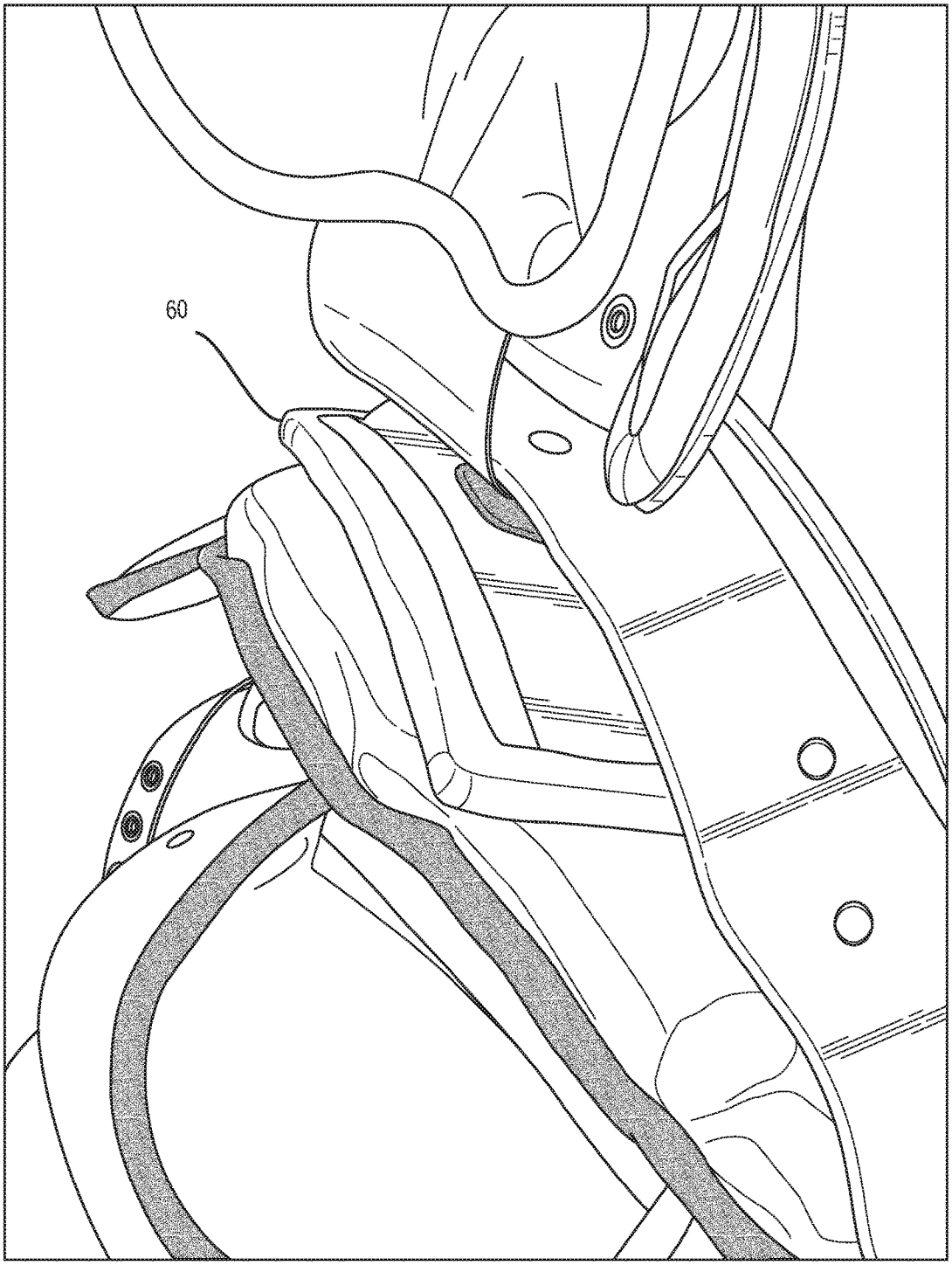
FIG. 21 is a view showing the redundant pad of FIGS. 18-19 as installed beneath the top of the right arch.

Additionally, as shown in FIGS. 18-21, the subject technology may include removable, redundant pads, for example redundant pad 60, inserted below the top of each of the left arch and right arch, to provide additional padding in those areas. The redundant pads are advantageously shaped with at least one curved edge, as shown in FIGS. 18-19. The redundant pads comprise a pad body made of slow-response foam, slow-rebound foam or memory foam; open-cell or closed-cell foam; polyurethane foam; ethylene-vinyl acetate (EVA) foam; polyethylene foam; polyurethane memory foam, polyether foam, or viscoelastic polymer gel. The body is encapsulated in a fabric shell, which may be a nylon shell heat-sealed to the foam body. A region or strip of hook/loop fastener material may be attached or sewn to one or both sides of the nylon shell, for removable engagement with the adjacent element of the shoulder pads. In use, the redundant pads are inserted beneath the top of each of the left arch and right arch, as best seen in FIGS. 20-21. Redundant pads as described and shown herein may be used in shoulder pads along with the padded epaulets previously described and shown. Alternatively, they may be used in conventional shoulder pads without padded epaulets.

While specific embodiments of the invention have been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention.

What is claimed is:

1. Shoulder pads for protecting the shoulders and body during sports play, the shoulder pads comprising:

a first arch, a second arch, the first arch flexibly connected to the second arch;

a first shoulder cap flexibly connected to the first arch;

a second shoulder cap flexibly connected to the second arch;

a first epaulet flexibly connected to the first arch and partially overlying the first shoulder cap;

a second epaulet flexibly connected to the second arch and partially overlying the second shoulder cap;

the first epaulet comprising a first concave shell and a first shock-absorbing epaulet pad comprising slow-response foam disposed on an inner surface of the first concave shell; and the second epaulet comprising a second concave shell and a second shock-absorbing epaulet pad comprising slow-response foam disposed on an inner surface of the second concave shell.

2. The shoulder pads of claim 1 wherein the first shock-absorbing epaulet pad and second shock-absorbing epaulet pad are kidney-shaped.

3. The shoulder pads of claim 1 wherein:

the first concave shell has a first ridge forming a concavity and a portion of the first shock-absorbing epaulet pad resides in the concavity formed by the first ridge; and the second concave shell has a second ridge forming a concavity and a portion of the second shock-absorbing epaulet pad resides in the concavity formed by the second ridge.

4. The shoulder pads of claim 1 wherein:

the first concave shell has a first ridge forming a first concavity and a portion of the first shock-absorbing epaulet pad resides in the first concavity; and the second concave shell has a second ridge forming a second concavity and a portion of the second shock-absorbing epaulet pad resides in the second concavity.

5. The shoulder pads of claim 1 wherein:

the first epaulet is flexibly connected to the first arch at a first connection area and the second epaulet is flexibly connected to the second arch at a second connection area;

the first shock-absorbing epaulet pad is shaped to define a concavity so that the first shock-absorbing epaulet pad does not cover the first connection area; and the second shock-absorbing epaulet pad is shaped to define a concavity so that the second shock-absorbing epaulet pad does not cover the second connection area.

6. The shoulder pads of claim 1 further comprising:

a left redundant pad inserted beneath the top of the left arch; and a right redundant pad inserted beneath the top of the left arch.

7. The shoulder pads of claim 1 wherein the first shock-absorbing epaulet pad and second shock-absorbing epaulet pad are not in contact with the wearer's body.

8. The shoulder pads of claim 6 wherein the left redundant pad and right redundant pad comprise slow-response foam encased in a nylon or fabric shell.

9. The shoulder pads of claim 1, wherein the first shock-absorbing epaulet pad contacts an outer surface of the first shoulder cap and the second shock-absorbing epaulet pad contacts an outer surface of the second shoulder cap.

10. The shoulder pads of claim 1 provided that the slow-response foam is effective to absorb shocks during sports play.

* * * * *